US009277616B1

(12) United States Patent
Jao et al.

(10) Patent No.: US 9,277,616 B1
(45) Date of Patent: Mar. 1, 2016

(54) LIGHT EMITTING DEVICE DRIVER CIRCUIT

(71) Applicants: Tong-Cheng Jao, Taichung (TW); Isaac Y. Chen, Zhubei (TW); Yi-Wei Lee, Taipei (TW)

(72) Inventors: Tong-Cheng Jao, Taichung (TW); Isaac Y. Chen, Zhubei (TW); Yi-Wei Lee, Taipei (TW)

(73) Assignee: RICHTEK TECHNOLOGY CORPORATION, Zhubei, Hsinchu (TW)

( * ) Notice: Subject to any disclaimer, the term of this patent is extended or adjusted under 35 U.S.C. 154(b) by 0 days.

(21) Appl. No.: 14/595,910

(22) Filed: Jan. 13, 2015

(30) Foreign Application Priority Data

Sep. 9, 2014 (TW) ..... 103130938 A

(51) Int. Cl.

| | |
|---|---|
| ***H05B 37/00*** | (2006.01) |
| ***H05B 39/00*** | (2006.01) |
| ***H05B 41/00*** | (2006.01) |
| ***H05B 33/08*** | (2006.01) |

(52) U.S. Cl.
CPC ..... *H05B 33/0827* (2013.01)

(58) Field of Classification Search
None
See application file for complete search history.

(56) References Cited

U.S. PATENT DOCUMENTS

| | | | | |
|---|---|---|---|---|
| 6,989,807 | B2 | 1/2006 | Chiang | |
| 7,081,722 | B1 | 7/2006 | Huynh et al. | |
| 2010/0134018 | A1 * | 6/2010 | Tziony et al. | 315/122 |
| 2010/0308739 | A1 * | 12/2010 | Shteynberg et al. | 315/193 |
| 2011/0273102 | A1 | 11/2011 | van de Ven et al. | |
| 2014/0339984 | A1 * | 11/2014 | Leung et al. | 315/122 |

* cited by examiner

*Primary Examiner* — Anh Tran
(74) *Attorney, Agent, or Firm* — Tung & Associates

(57) ABSTRACT

The present invention discloses a light emitting device driver circuit. The light emitting device driver circuit drives a light emitting device circuit. The light emitting device circuit includes plural light emitting devices connected in series and a diode circuit, wherein the plural light emitting devices are divided to plural groups. The light emitting device driver circuit includes: a first switch circuit, a second switch circuit, a current source circuit, and a control circuit. The first switch circuit includes plural first switches connected in parallel to the corresponding groups respectively. The second switch circuit includes plural second switches coupled to a forward end and a reverse end of the diode circuit respectively, wherein the second switch circuit determines whether to conduct the forward end or the reverse end to the current source circuit according to the voltages of the forward end and the reverse end.

10 Claims, 7 Drawing Sheets

LIGHT EMITTING DEVICE DRIVER CIRCUIT

CROSS REFERENCE

The present invention claims priority to TW 103130938, filed on Sep. 9, 2014.

BACKGROUND OF THE INVENTION

1. Field of Invention

The present invention relates to a light emitting device driver circuit; particularly, it relates to such light emitting device driver circuit with relatively fewer high voltage switches.

2. Description of Related Art

FIG. 1A shows a schematic diagram of a prior art light emitting diode (LED) driver circuit 10 and its related circuits. As shown in FIG. 1A, the LED driver circuit 10 includes a switch circuit 11, a switch control circuit 12, and a constant current source 13. The LED driver circuit 10 drives an LED circuit 20. The LED circuit 20 includes plural LEDs connected in series, e.g., LED1, LED2, LED3, and LED4 as shown in FIG. 1. The switch circuit 11 includes plural switches (e.g., four switches S1, S2, S3, and S4 as shown in FIG. 1), which are electrically connected to the corresponding LEDs LED1, LED2, LED3, and LED4 respectively. A rectifier circuit 30 rectifies an AC voltage from an AC power source 40, to generate a rectified input voltage Vin as shown in FIG. 1B. The LED driver circuit 10 drives the LED circuit 20 by respectively turning ON and OFF the switches S1-S4 according to the level of the rectified input voltage Vin, such that one or more of the LEDs LED1-LED4 glow accordingly.

For example, as shown by the signal waveforms in FIG. 1B, when the level of the rectified input voltage Vin is lower than level L1, the switch control circuit 12 turns OFF the switches S1-S4. When the level of the rectified input voltage Vin is between levels L1 and L2, the switch control circuit 12 turns ON the switch S1 and turns OFF the switches S2-S4, whereby the LED LED1 glows. Similarly, when the level of the rectified input voltage Vin is between levels L2 and L3, the switch S2 is turned ON, and the switches S1 and S3-S4 are turned OFF, whereby the LEDs LED1-LED2 glow. Similarly, when the level of the rectified input voltage Vin is between levels L3 and L4, the switch S3 is turned ON, and the switches S1-S2 and S4 are turned OFF, whereby the LEDs LED1-LED3 glow. Similarly, when the level of the rectified input voltage Vin exceeds level L4, the switch S4 is turned ON, and the switches S1-S3 are turned OFF, whereby the LEDs LED1-LED4 glow. U.S. Pat. No. 6,989,807, U.S. Pat. No. 7,081,722 and US 2011/0273102 are relevant prior art patents for reference.

In such prior art, the current source 13 provides a constant current, that is, when one or more of the LEDs LED1-LED4 glow, a current I1 flowing through the conductive LED(s) is the constant current. Referring to the signal waveform of the current I1 as shown in FIG. 1B, regardless how many of the LEDs LED1-LED4 glow, the current flowing through the conductive LED(s) is the constant current. Only when the level of the rectified input voltage Vin is lower than the level L1, i.e., when all the switches S1-S4 are turned OFF, the current I1 is zero current.

In comparison with a conventional driver circuit which drives the LED circuit with a DC voltage, an advantage of the prior art LED driver circuit 10 is that: the manufacturing cost of the LED driver circuit 10 is relatively lower because it does not need to convert the rectified input voltage to a DC voltage.

If the rectified input voltage has a frequency which is enough high, naked eyes will not perceive any flicker of the LED circuit 20. However, a disadvantage of the prior art LED driver circuit 10 is that each LED requires to be connected to a corresponding high voltage switch, and each high voltage switch requires to be connected to a corresponding pin in the LED driver circuit 10; therefore, the size and manufacturing cost of the switch control circuit 12 are relatively high.

In view of above, the present invention proposes a light emitting device driver circuit with relatively fewer high voltage switches.

SUMMARY OF THE INVENTION

From one perspective, the present invention provides a light emitting device driver circuit for driving a light emitting device circuit which is operative according to a rectified input voltage, the light emitting device circuit including a plurality of light emitting devices connected in series and a diode circuit, wherein the diode circuit includes at least one diode or a light emitting diode (LED), and wherein the light emitting device circuit and the diode circuit are connected in series, the plural light emitting devices being divided into a plurality of groups, wherein each group includes at least one light emitting device, the light emitting device driver circuit comprising: a first switch circuit, which includes a plurality of first switches, wherein each first switch is connected to a corresponding one of the groups in parallel; a second switch circuit, which includes a plurality of second switches, wherein each forward end and each reverse end of each diode or LED in the diode circuit is coupled to a corresponding one of the second switches; a current source circuit, which is coupled to the second switch circuit, for providing a light emitting device current when at least one of the light emitting devices is conductive, wherein the second switch circuit determines whether to electrically connect the forward end or the reverse end of the at least one diode or LED in the diode circuit to the current source circuit according to voltages of the forward end and the reverse end; and a control circuit, which is coupled to the first switch circuit, for generating an operation signal according to an adjustment signal, to operate at least one first switch of the first switch circuit to determine which of the light emitting devices is conductive.

In one preferable embodiment, each diode or LED in the diode circuit has a same forward threshold voltage as at least one of the light emitting devices.

In one preferable embodiment, the adjustment signal is related to the voltages of the forward end and the reverse end of the at least one diode or LED.

In one preferable embodiment, the light emitting device driver circuit further includes an adjustment signal generation circuit, which includes: a first comparison circuit, for comparing the voltage of the forward end with a reference signal to generate a first comparison signal; a second comparison circuit, for comparing the voltage of the reverse end with a voltage difference to generate a second comparison signal, wherein the voltage difference is related to the voltage of the forward end minus the voltage of the reverse end; and a counter, which is coupled to the first comparison circuit and the second comparison circuit, for generating the adjustment signal according to the first comparison signal and the second comparison signal.

In one preferable embodiment, the second switch circuit includes: the plural second switches, wherein each of the second switch has a second switch current inflow end, a second switch current outflow end, and a second switch control end, wherein the second switch current inflow end is coupled to the forward end or the reverse end, and the second switch current outflow end is coupled to the current source circuit; a plurality of predetermined current sources; a plurality of third switches, wherein each of the third switches has a third switch current inflow end, a third switch current outflow end, and a third switch control end, wherein the third switch current inflow end is for receiving a current generated by a corresponding one of the predetermined current sources, and is coupled to the second switch control end, and the third switch control end is coupled to the second switch current outflow end of the corresponding second switch; and a plurality of resistors, each of which is coupled to the third switch current outflow end of a corresponding one of the third switches.

In one preferable embodiment, the light emitting device circuit further includes an additional group including at least one additional light emitting device which is not one of the plurality of light emitting devices connected in series, the additional group being connected in series with the plurality of light emitting devices connected in series, and the additional group being not connected to any switch in parallel.

In one preferable embodiment, the light emitting device driver circuit further includes a sensing circuit which is coupled to the first switch circuit and/or the second switch circuit, for generating the adjustment signal according to a voltage drop across, a current flowing through, or a turned-ON or turned-OFF time point of one or more first switches and/or one or more second switches.

In one preferable embodiment, the light emitting device driver circuit further includes a comparison circuit, which is coupled to the rectified input voltage, for generating a comparison result according to the rectified input voltage and a predetermined level; and a timer circuit, which is coupled to the comparison circuit, for counting a predetermined time period since the rectified input voltage exceeds the predetermined level, to generate the adjustment signal.

In one preferable embodiment, the light emitting device driver circuit further includes a peak detection and storage circuit, which is coupled to the rectified input voltage, for storing a peak level of the rectified input voltage in an immediate previous cycle; and a differential circuit, which is coupled to the peak detection and storage circuit, for generating the adjustment signal according to a difference of the current rectified input voltage and the peak level.

In one preferable embodiment, a number of the light emitting device or devices of at least one of the groups is different from another group.

The objectives, technical details, features, and effects of the present invention will be better understood with regard to the detailed description of the embodiments below.

DESCRIPTION OF THE PREFERRED EMBODIMENTS

Figure 1A:
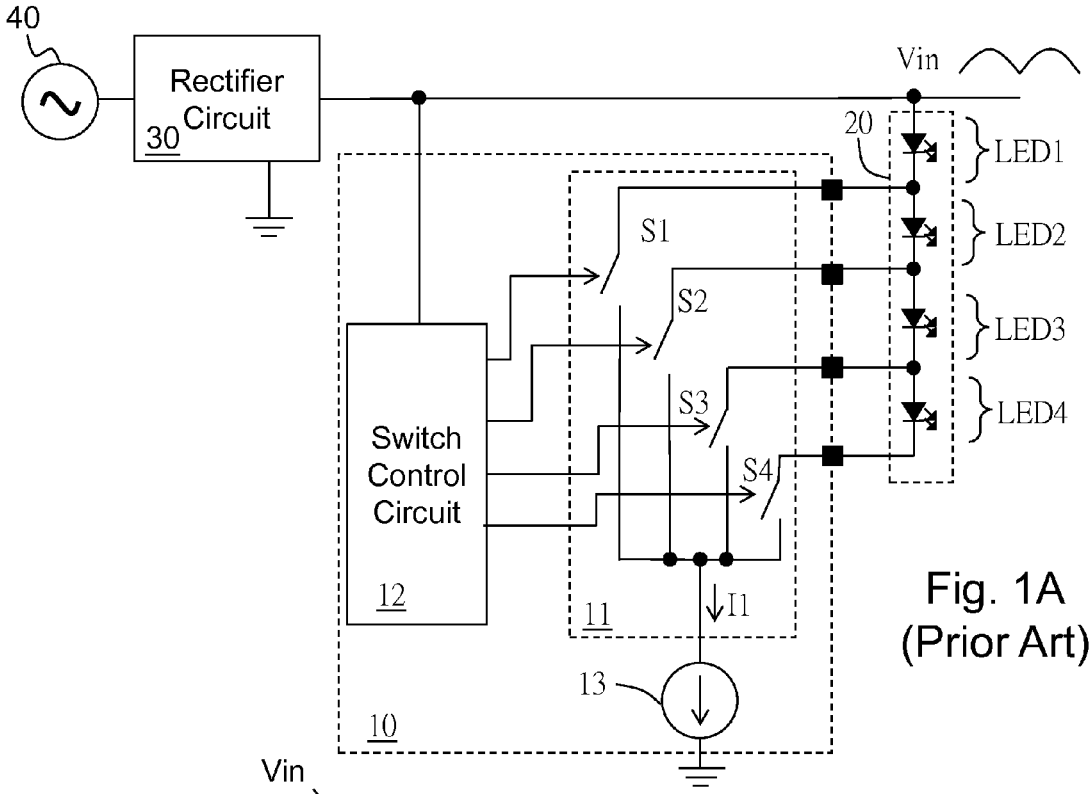
Fig. 1A (Prior Art)
FIG. 1A shows a schematic diagram of a prior art light emitting diode (LED) driver circuit 10 and its related circuits.
Figure 1B:
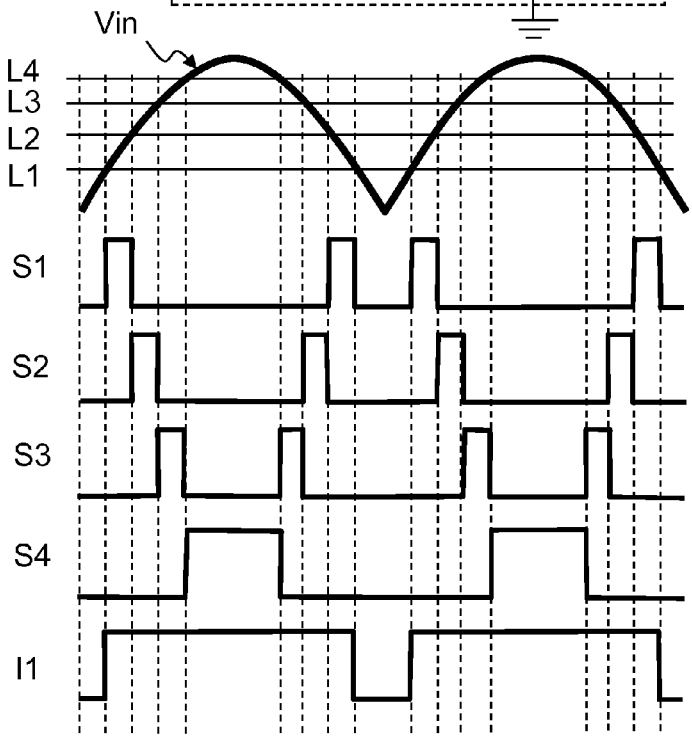
Fig. 1B (Prior Art)
FIG. 1B shows a schematic diagram of the signal waveforms of the prior art LED driver circuit 10 and its related circuits.
Figure 2:
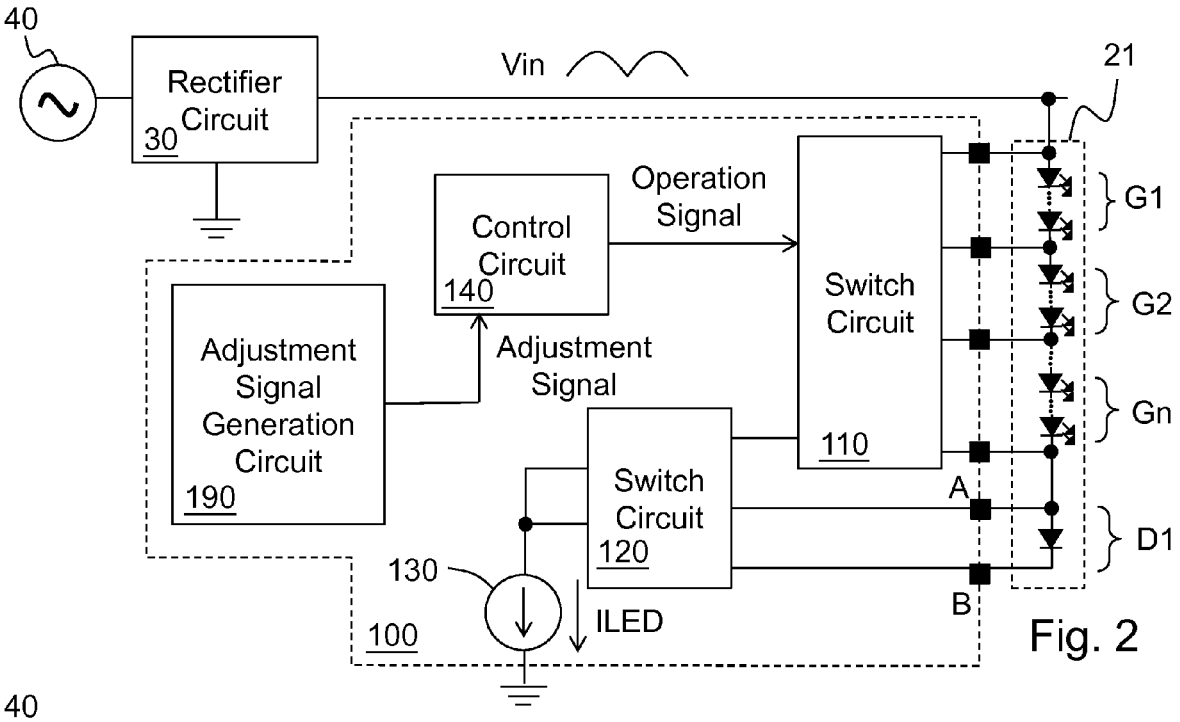
FIG. 2 shows a first embodiment of the present invention.

Please refer to FIG. 2 for a first embodiment according to the present invention. As shown in FIG. 2, a light emitting device driver circuit 100 drives a light emitting device circuit 21. The light emitting device circuit 21 includes plural light emitting devices connected in series and a diode circuit D1, and the plural light emitting devices and the diode circuit D1 are connected in series. The plural light emitting devices are divided into plural groups, such as groups G1, G2 . . . to Gn, and each group includes at least one light emitting device as shown in the figure. The light emitting device circuit 21 receives the rectified input voltage Vin generated from the rectifier circuit 30. The light emitting device is for example but not limited to an LED as shown in the figure. In this embodiment shown in FIG. 2, the light emitting device circuit 21 includes one single LED string (and the diode circuit D1 connected in series to the single LED string), which is only one example; according to the present invention, in another embodiment, the light emitting device circuit 21 may include an LED array consisting of plural LED strings connected in parallel, or a light emitting device string(s) or a light emitting device array in other forms. The diode circuit D1 includes at least one diode; the diode is for example but not limited to an LED having the same specification as an LED in the LED string, or the diode is for example but not limited to a diode having the same forward threshold voltage as an LED in the LED string.

Still referring to FIG. 2, the light emitting device driver circuit 100 includes a switch circuit 110, a switch circuit 120, a current source circuit 130, a control circuit 140, and an adjustment signal generation circuit 190. The switch circuit 110 is coupled to the light emitting device circuit 21, and the switch circuit 110 includes switches corresponding to the groups G1-Gn, wherein the switches are connected to the groups G1-Gn of the light emitting device circuit 21 in parallel respectively. The control circuit 140 is coupled to the switch circuit 110, and the control circuit 140 generates an operation signal according to an adjustment signal which is generated by the adjustment signal generation circuit 190. The operation signal controls at least one switch of the switch circuit 110 to determine the conductive light emitting device(s). There are various ways for the adjustment signal generation circuit 190 to generate the adjustment signal, and some embodiments will be described in details later. The switch circuit 120 is coupled to the diode circuit D1, and the switch circuit 120 determines whether a node A (forward end of the diode circuit D1) or a node B (reverse end of the diode circuit D1) is electrically connected to the current source circuit 130 according to the voltages of the node A and the node B. The current source circuit 130 is coupled to the switch circuit 120, and the current source circuit 130 provides a light emitting device current ILED to the conductive light emitting device(s).

Figure 3:
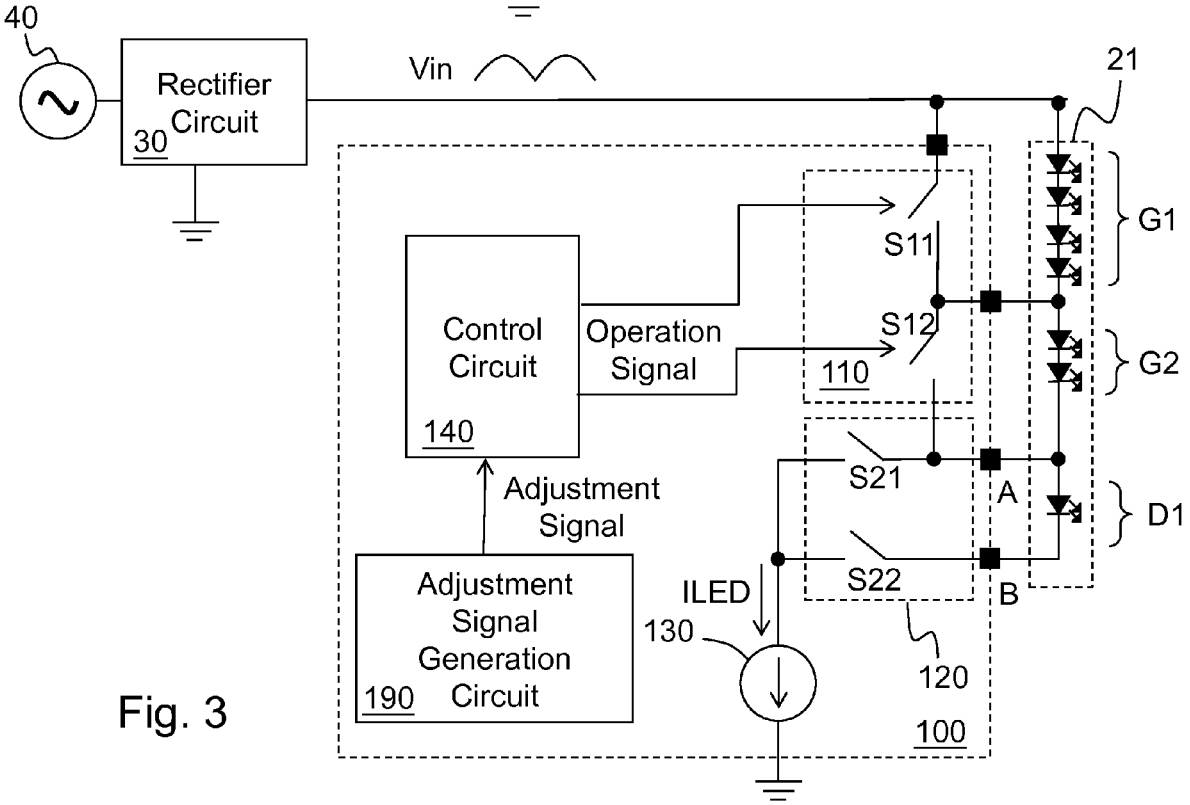
FIG. 3 shows a second embodiment of the present invention.

FIG. 3 shows a second embodiment of the present invention. In this embodiment, the light emitting device circuit 21 includes for example but not limited to the groups G1 and G2, and the diode circuit D1 connected in series. The group G1 for example has 4 LEDs connected in series, and the group G2 for example has 2 LEDs connected in series, and the diode circuit D1 for example has one LED. The switch circuit 110 for example includes switches S11 and S12, which are connected to the corresponding groups G1 and G2 in parallel respectively. The switch circuit 120 for example includes switches S21 and S22, which are coupled between the node A and the current source circuit 130, and the node B and the current source circuit 130, respectively (a control circuit for controlling the switches S21 and S22 is not shown for simplicity of the drawing, which will be described later). As the rectified input voltage Vin is in a rising stage wherein its level rises from being capable of turning ON one LED to being capable of turning ON all seven LEDs of the light emitting device circuit 21, the conductive switches and the conductive groups for example may be arranged as below:

| Sequence | Conductive Switch (es) | Conductive group (s) |
|---|---|---|
| 1 | S11, S12, S22 | D1 |
| 2 | S11, S21 | G2 |
| 3 | S11, S22 | G2 and D1 |
| 4 | S12, S21 | G1 |
| 5 | S12, S22 | G1 and D1 |
| 6 | S21 | G1 and G2 |
| 7 | S22 | G1, G2, and D1 |

On the other hand, as the rectified input voltage Vin is in a falling stage wherein its level falls from being capable of turning ON all seven LEDs to being capable of turning ON only one LED of the light emitting device circuit 21, the conductive switches and the conductive groups for example may be arranged as below:

| Level | Conductive Switch (es) | Conductive group (s) |
|---|---|---|
| 1 | S22 | G1, G2, and D1 |
| 2 | S21 | G1 and G2 |
| 3 | S12, S22 | G1 and D1 |
| 4 | S12, S21 | G1 |
| 5 | S11, S22 | G2 and D1 |
| 6 | S11, S21 | G2 |
| 7 | S11, S12, S22 | D1 |

Note that a number of the light emitting device(s) of each group in this embodiment is a power of 2. This arrangement is advantageous over the arrangement that each group has the same number of light emitting device(s), because the present invention requires fewer switches. Certainly, the aforementioned arrangement by the power of 2 is only one preferable embodiment, and the present invention is not limited to this. According to the present invention, the number of switches in the switch circuit 120 can be reduced as long as at least one group has a different number of light emitting device(s) from another group.

Figure 4:
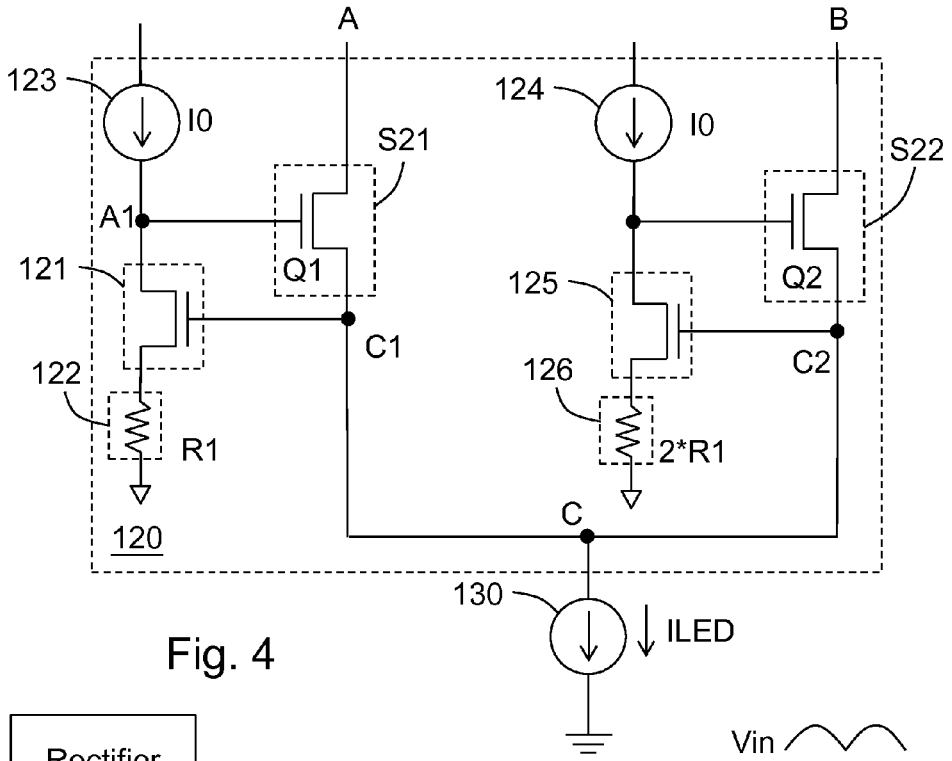
FIG. 4 shows a third embodiment of the present invention.

FIG. 4 shows a third embodiment of the present invention. This embodiment shows a more specific embodiment of the switch circuit 120 according to the present invention. As shown in FIG. 4, the switch circuit 120 includes for example but not limited to plural switch groups, such as two switch groups (a first switch group and a second switch group) which are connected to the nodes A and B respectively. The transistors Q1 and Q2 correspond to the switches S21 and S22 in the second embodiment of FIG. 3, respectively. The first switch group includes the transistor Q1, a switch 121, a resistor 122, and a current source 123. The second switch group includes the transistor Q2, a switch 125, a resistor 126, and a current source 124. The connections between the devices of the switch group are explained by taking the first switch group including the transistor Q1 as an example, whereas the connections between the devices of the second switch group including the transistor Q2 are similar. The switch 121 includes for example but not limited to a transistor as shown in the figure. The switch 121 has a current inflow end coupled to a control end of the transistor Q1, and the current inflow end receives a current I0 provided by the current source 123. The switch 121 has a current outflow end coupled to the resistor 122. The transistor Q1 (corresponding to the switch S21) has a current inflow end coupled to the node A. The transistor Q1 has a current outflow end coupled to the current source circuit 130, and the current outflow end of the transistor Q1 is also coupled to a control end of the switch 121. The upper ends of the current sources 123 and 124 may be connected to any proper level.

The operation of the switch circuit 120 is now explained by taking the aforementioned second embodiment as an example. Referring to FIG. 4, when the conductive group(s) is changed from the group G2 to the groups D1 and G2, i.e., the number of the conductive LEDs is increased from 2 to 3, the conductive switches are changed from the switches S11 and S21 to the switches S11 and S22, wherein the switch S11 of the switch circuit 110 remains conductive, and the conductive switch in the switch circuit 120 is changed from the switch S21 to the switch S22. The operation process is thus. First, when the level of the rectified input voltage Vin is high enough for turning ON (conducting) two but not three LEDs, the voltage of the node A is high enough for the first switch group to operate normally, but the voltage of the node B is not high enough and the second switch group is inoperative, so the switch S21 is conductive but the switch S22 is not conductive. According to basic circuit principle, the voltage at the node C1 shown in FIG. 4 will be kept at I0*R1+Vgs, wherein I0 is the current flowing through the current source 123, R1 is the resistance of the resistor 122 and Vgs is the gate-to-source voltage of the switch 121 (the switch 121 is for example an NMOS device), and the voltages of the nodes C and C2 are the same as the node C1, so the voltages of the nodes C and C2 are also equal to I0*R1+Vgs.

As the level of the rectified input voltage Vin rises, the voltage of the node A also rises, and when the voltage of the node A is higher than the voltage of the node B by a forward threshold voltage of the LED, the LED of the diode circuit D1 will be conductive. The voltage of the node B is high enough for the second switch group to operate normally, and therefore the voltage of the node C2 shown in FIG. 4 will be kept at I0*2*R1+Vgs, wherein I0 is the current flowing through the current source 124, 2*R1 is the resistance of the resistor 126 and Vgs is the gate-to-source voltage of the switch 125 (the switch 125 is for example an NMOS device), and the voltages of the nodes C and C1 are same as the node C2, so the voltages of the nodes C and C1 are also equal to I0*2*R1+Vgs. When the voltage of the node C is maintained at I0*2R1+Vgs, the voltage of the node A is not high enough to turn ON the switch S21, and therefore the switch S21 is not conductive. Note that in order to simply the explanation, in the aforementioned embodiment, the current I0 flowing through the current source 124 is the same as the current I0 flowing through the current source 123; the gate-to-source voltage Vgs of the switch 125 is the same as the gate-to-source voltage Vgs of the switch 121; and the resistance (2*R1) of the resistor 126 is twice the resistance (R1) of the resistor 122. However, the present invention is not limited by these parameters and ratio; they can be adjusted as long as the switch S21 is turned OFF when the switch S22 is turned ON. For example, the resistance of the resistor 126 may be changed to the resistance R1, and correspondingly the current flowing through the current source 124 may be changed to the current 2*I0; for another example, the parameters such as the voltage Vgs of the gate-source voltage of the switches 121 and 125 can be changed; for another example, the ratio of the resistance of the resistor 126 over the resistance of the resistor 122 can be changed to another number other than two. These changes and modifications are within the spirit of the present invention.

On the other hand, when the conductive groups are changed from the groups D1 and G2 to the group G2, i.e., the number of the conductive LEDs is decreased from 3 to 2, the conductive switches are changed from the switches S11 and S22 to the switches S11 and S21. More specifically, as the level of the rectified input voltage Vin decreases, the voltage of the node A also decreases, and when the voltage of the node A is lower than the voltage of the node B plus a forward threshold voltage of the LED, the LED of the diode circuit D1 will not be conductive. The voltage of the node B is not high enough for the second switch group to operate normally, and therefore the voltage of the node C1 shown in FIG. 4 will drop from I0*2*R1+Vgs to I0*R1+Vgs.

Figure 5:
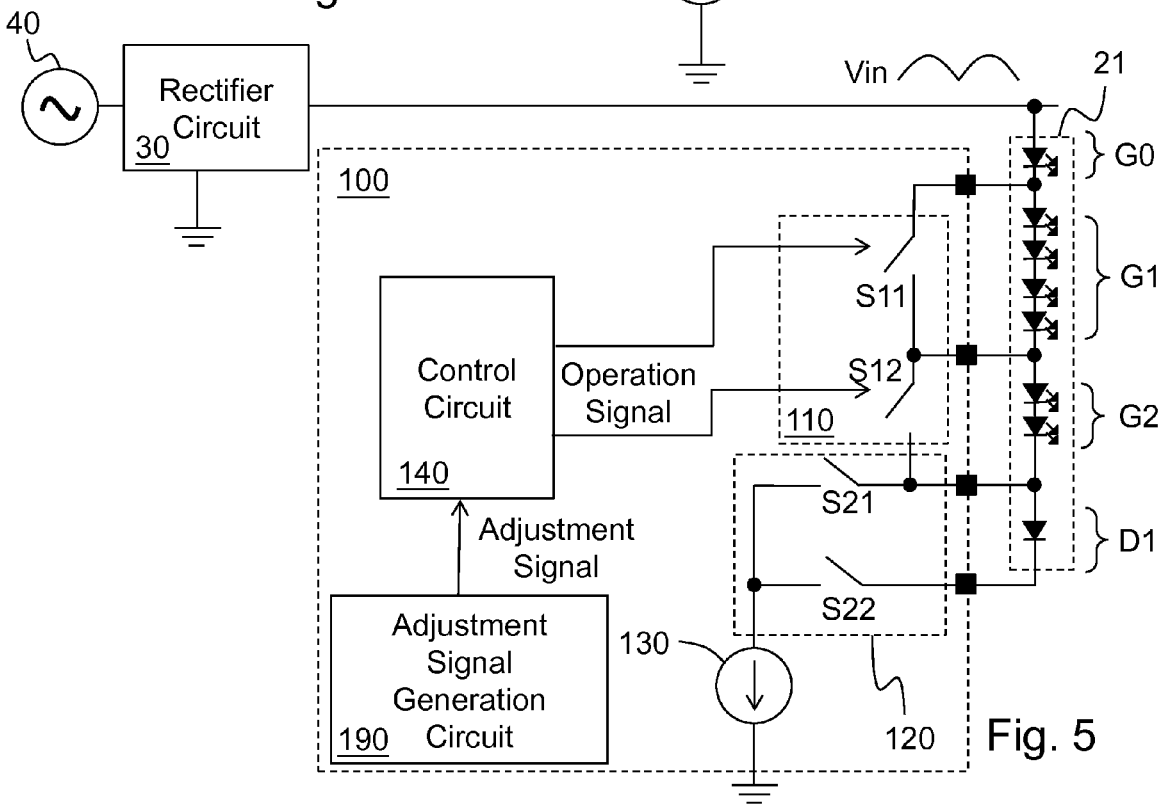
FIG. 5 shows a fourth embodiment of the present invention.

FIG. 5 shows a fourth embodiment of the present invention. This embodiment is different from the second embodiment in that, in this embodiment, the light emitting device circuit 21 further includes a group G0, which is connected to the other groups G1 and G2 in series, and there is not a corresponding switch connected to the group G0 in parallel; the group G0 receives the rectified input voltage Vin directly. This embodiment indicates that, according to the present invention, it is not necessary for every one of the groups of the light emitting device circuit 21 to be connected to a corresponding parallel switch in the switch circuit 110; instead, there may be one or more groups, such as the group G0 shown in FIG. 5, which is not connected to a corresponding parallel switch in the switch circuit 110.

Figure 6:
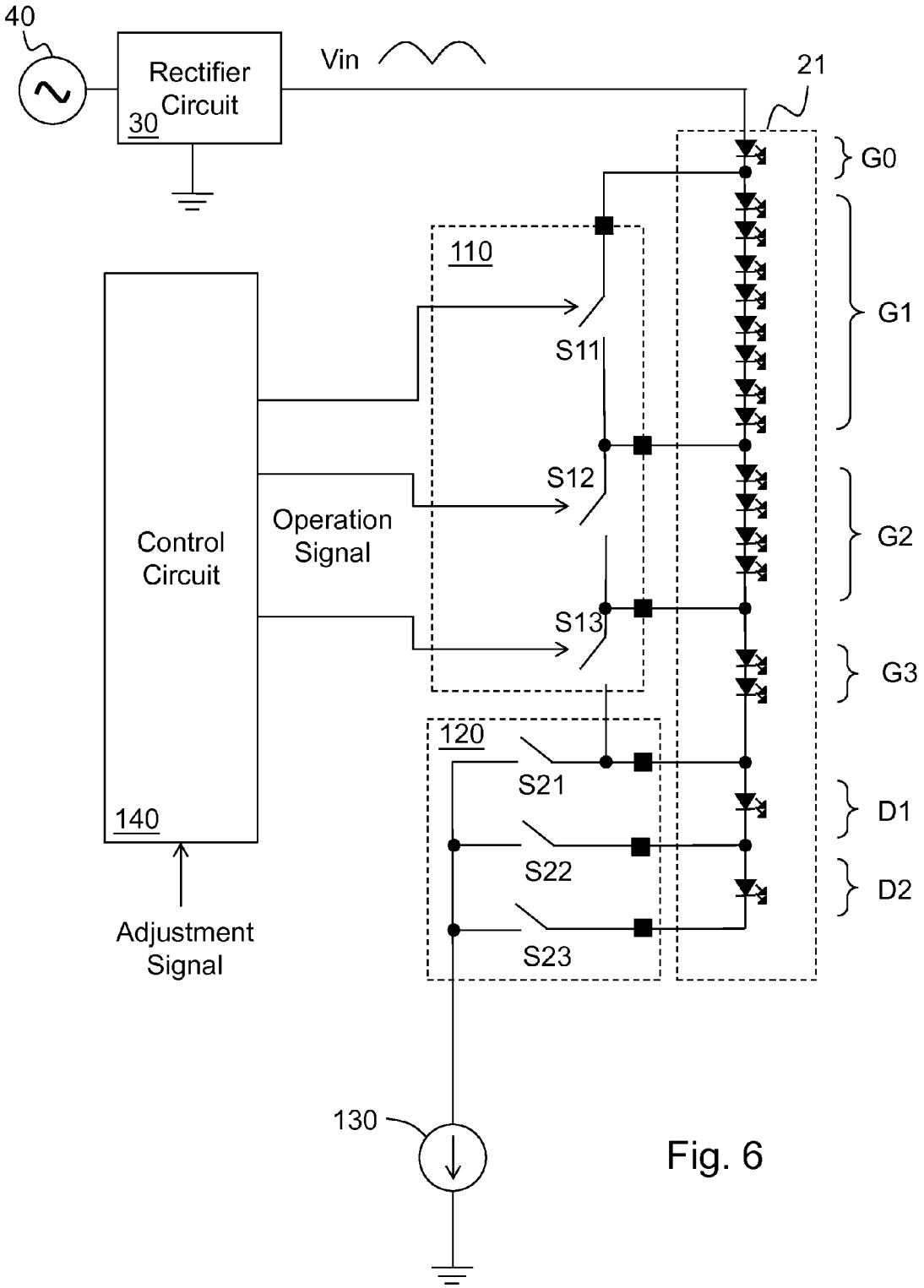
FIG. 6 shows a fifth embodiment of the present invention.

FIG. 6 shows a fifth embodiment of the present invention. This embodiment shows the light emitting device circuit 21 having more LEDs compared to the second embodiment. As shown in the figure, the light emitting device circuit 21 includes for example but not limited to groups G0, G1, G2, and G3, and diode circuits D1 and D2 connected in series. The group G0 for example has one LED; the group G1 for example has 8 LEDs connected in series; the group G2 for example has 4 LEDs connected in series; the group G3 for example has 2 LEDs connected in series; and each of the diode circuits D1 and D2 for example has one LED. When the level of the rectified input voltage Vin increases from a relatively lower voltage sufficient for turning ON only one LED to a relatively higher voltage sufficient for turning ON all seventeen LEDs in the rising stage, the control circuit 140 generates the operation signal to control the switches S11, S12, and S13 of the switch circuit 110 according to the adjustment signal, and the switch circuit 120 turns ON and OFF the switches S21, S22, and S23 respectively according to the levels of the forward ends and the reverse ends of the diode circuits D1 and D2. In this embodiment, the switches S11, S12, S13, S21, S22, and S23 operate to conduct the groups during the rising stage of the rectified input voltage Vin by for example but not limited to the sequence listed below: G0; G0 and D1; G0, D1, and D2; G0 and G3; G0, G3, and D1; G0, G3, D1, and D2; G0 and G2, G0, G2, and D1; G0, G2, D1, and D2; G0, G2, and G3; G0, G2, G3, and D1; G0, G2, G3, D1, and D2; G0 and G1; G0, G1, and D1; G0, G1, D1, and D2; G0, G1, and G3; G0, G1, G3, and D1; G0, G1, G3, D1, and D2; G0, G1, G2, and G3; G0, G1, G2, G3, and D1; and G0, G1, G2, G3, D1, and D2. On the other hand, the switches S11, S12, S13, S21, S22, and S23 operate to conduct the groups during the falling stage of the rectified input voltage Vin by for example but not limited to a reverse sequence of the aforementioned sequence.

A more specific embodiment of the switch circuit 120 for the fifth embodiment shown in FIG. 6 is for example but not limited to a modification of the third embodiment shown in FIG. 4 with an additional third switch group (not shown). The additional third switch group has the same devices and structure as the first switch group and the second switch group, but the resistance of the resistor is 3*R1 (or, as described in the above, a certain parameter or the ratio can be changed), such that when the third switch group is in normal operation, the switches S11 and S12 are not conductive.

The fifth embodiment shown in FIG. 6 indicates a coding method which increases and decreases the number of the conductive light emitting device(s) during the rising and falling stages of the rectified input voltage Vin by varying a combination of the conductive group(s). Therefore, the present invention can control relatively more light emitting devices with relatively fewer switches, which is one advantage of the present invention over the prior art. Particularly, in the structure of providing the rectified input voltage Vin directly to the light emitting device circuit, switches which can sustain a high voltage are required, (such as the switches S1-S4 of the prior art LED driver circuit 10, and the switches S11-S13 and S21-S23 in the embodiments of the present invention), but such high voltage switches occupy a relatively larger space. Therefore, since the present invention reduces the number of the required high voltage switches, the area of the entire circuitry is reduced, and the manufacturing cost is relatively lower. Further, the switches 121 and 125 in the switch circuit 120 of the present invention do not need to sustain a high current, and therefore, they can be made by relatively smaller transistors; in contrast, in the prior art, all transistors in the switch control circuit 12 need to sustain the high current, and therefore, they have to be relatively larger transistors. This is another advantage of the present invention over the prior art.

Figure 7:
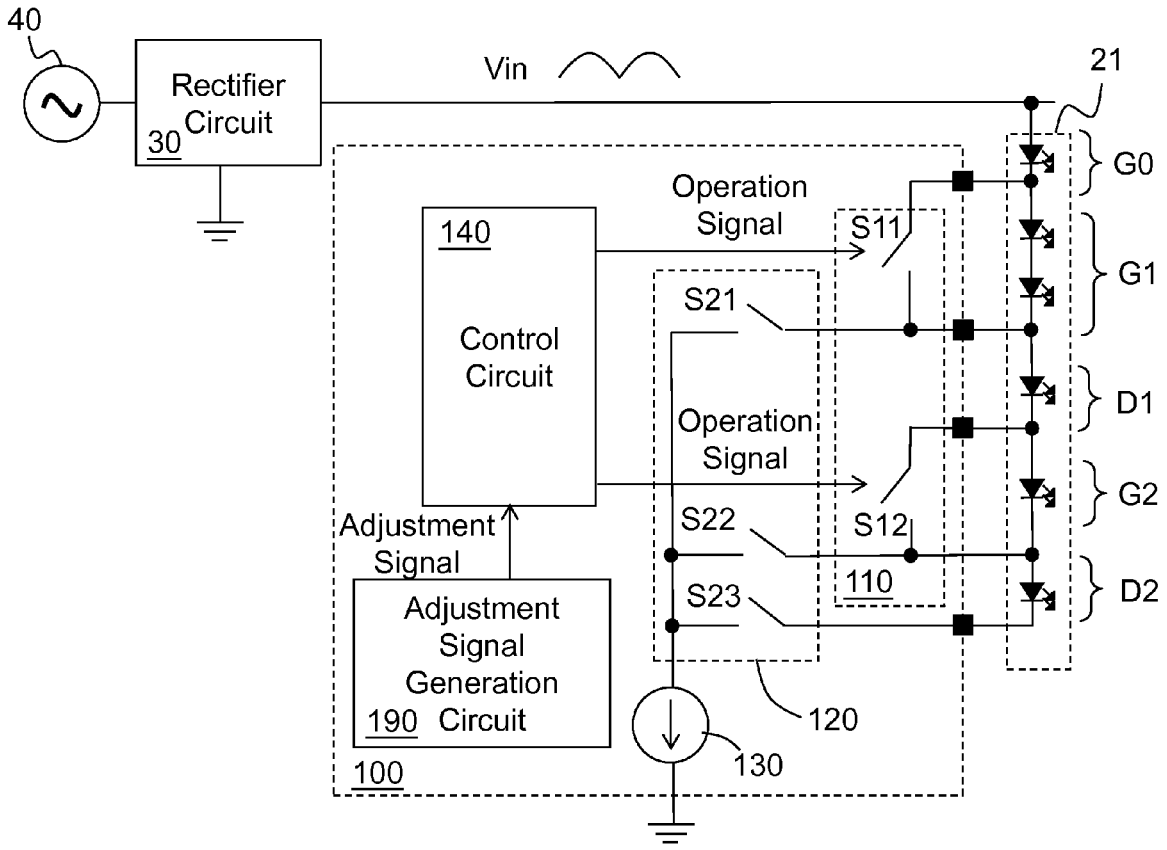
FIG. 7 shows a sixth embodiment of the present invention.

FIG. 7 shows a sixth embodiment of the present invention. This embodiment indicates that the series connection of the diode circuits D1 and D2 and the groups G0, G1, and G2, is not limited to a series connection as shown in FIGS. 2-6, wherein the groups G0, G1, and G2 are connected together and the diode circuits D1 and D2 are connected in series to an end of the groups G0, G1, and G2; instead, in this embodiment, the connection may be as shown in FIG. 7, wherein at least one of the diode circuits D1 and D2 are arranged between two of the groups G0, G1, and G2. As shown in FIG. 7, the group G0 for example has one LED; the group G1 for example has two LEDs; and the diode circuits D1 and D2 for example have one LED respectively. When the level of the rectified input voltage Vin increases from a relatively lower voltage sufficient for turning ON only one LED to a relatively higher voltage sufficient for turning ON all six LEDs in the rising stage, the control circuit 140 generates the operation signal to control the switches S11 and S12 of the switch circuit 110 according to the adjustment signal, and the switch circuit 120 turns ON and OFF the switches S21, S22, and S23 respectively according to the levels of the forward ends and the reverse ends of the diode circuits D1 and D2. In this embodiment, the switches S11, S12, S21, S22, and S23 operate to conduct the groups during the rising stage of the rectified input voltage Vin by for example but not limited to the sequence listed below: G0; G0 and D1; G0, D1, and D2; G0 and G1; G0, G1, and D1; G0, G1, D1, and D2; G0, G1, D1, and G2; and G0, G1, G2, D1, and D2. On the other hand, the switches S11, S12, S21, S22, and S23 operate to conduct the groups during the falling stage of the rectified input voltage Vin by for example but not limited to a reverse sequence of the aforementioned sequence.

Figure 8:
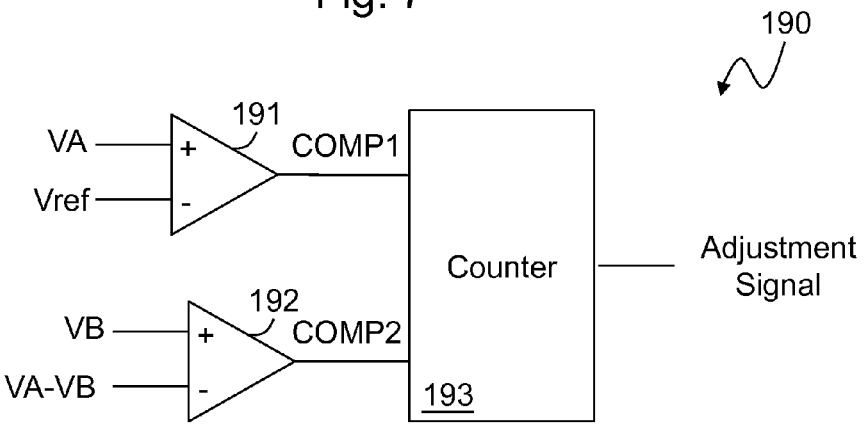
FIG. 8 shows a seventh embodiment of the present invention.

FIG. 8 shows a seventh embodiment of the present invention. This embodiment shows a more specific embodiment of the adjustment signal generation circuit 190. As shown in FIG. 8, in this embodiment, the adjustment signal generation circuit 190 includes comparison circuits 191 and 192, and a counter 193. The comparison circuit 191 compares a voltage VA at the node A with a reference voltage Vref to generate a comparison result COMP1 which is inputted to the counter 193. For example, when the voltage VA is lower than the reference voltage Vref, the comparison result COMP1 indicates that the number of the conductive LEDs should be decreased by one. Accordingly, the switch circuit 120 operates to change the combination of the conductive groups so that the number of the conductive LEDs is decreased by one. On the other hand, the comparison circuit 192 compares a voltage VB at the node B with a voltage difference VA-VB to generate a comparison result COMP2 which is inputted to the counter 193. For example, when the voltage VB is higher than the voltage difference VA-VB, the comparison result COMP2 indicates that the number of the conductive LEDs should be increased by one. Accordingly, the switch circuit 120 operates to change the combination of the conductive groups so that the number of the conductive LEDs is increased by one. The sequence control of the conductive groups for example can follow the embodiments as described in the above.

Figure 9:
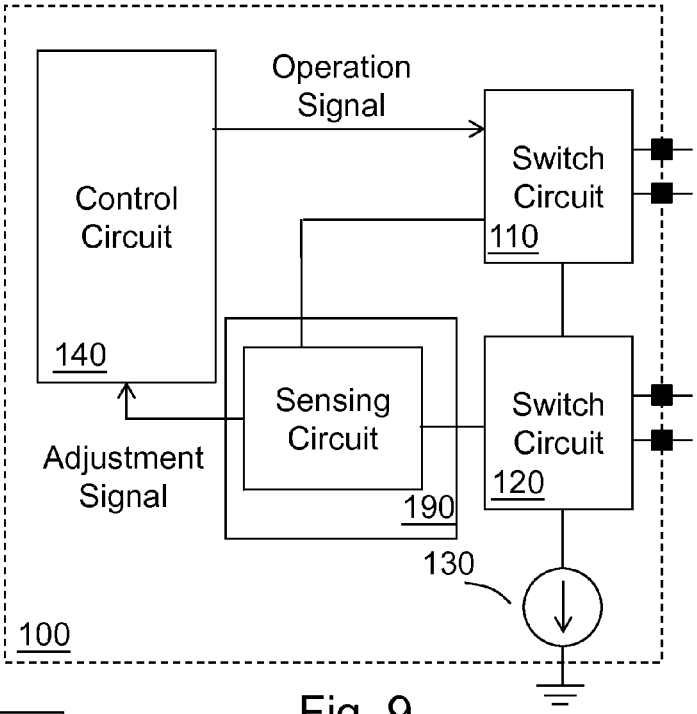
FIG. 9 shows an eighth embodiment of the present invention.

FIG. 9 shows an eighth embodiment of the present invention. This embodiment shows another more specific embodiment of the adjustment signal generation circuit 190. As shown in FIG. 9, in this embodiment, the adjustment signal generation circuit 190 includes a sensing circuit 150, which is coupled to the switch circuit 110 and/or the switch circuit 120, for sensing a voltage drop across, a current flowing through, or a turned-ON or turned-OFF time point of one or more switches of the switch circuit 110 and/or the switch circuit 120, to generate the adjustment signal. In short, the voltage drop across or the current flowing through the switch(es) can indicate the condition of the conductive light emitting device(s), whereby the control circuit 140 can predict the time point to change the combination of the conductive groups if the frequency of the rectified input voltage Vin is known.

Figure 10:
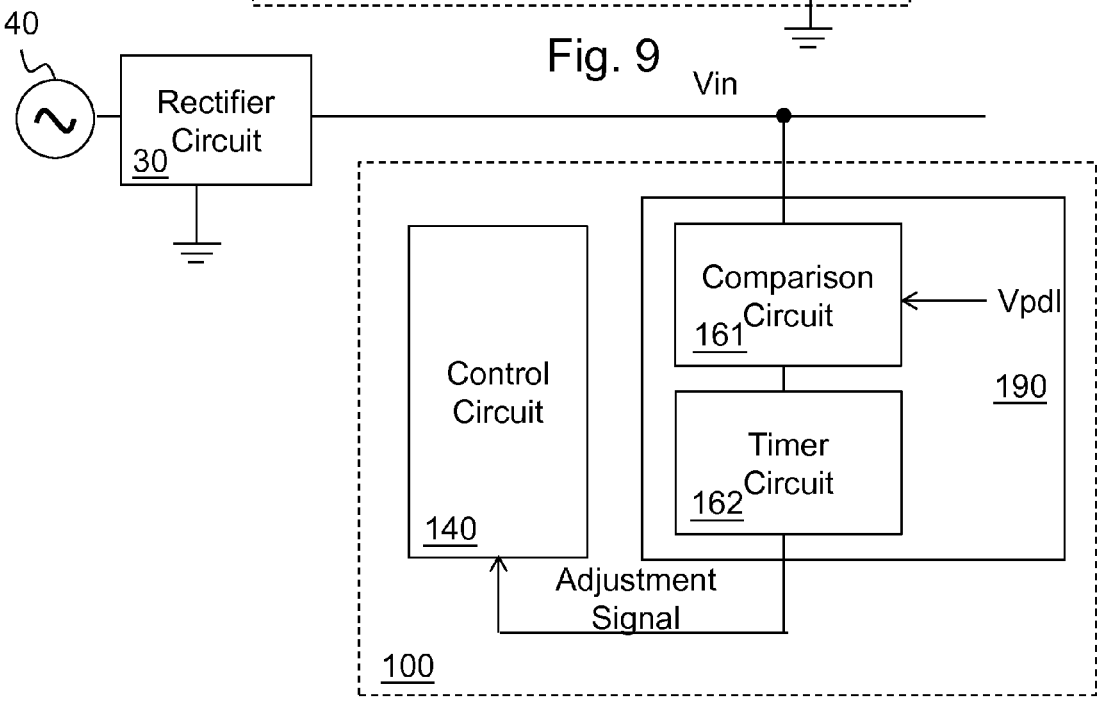
FIG. 10 shows a ninth embodiment of the present invention.

FIG. 10 shows a ninth embodiment of the present invention. This embodiment shows another embodiment of the adjustment signal generation circuit 190. As shown in FIG. 10, in this embodiment, the adjustment signal generation circuit 190 includes a comparison circuit 161 and a timer circuit 162. The comparison circuit 161 is coupled to the rectified input voltage Vin, for generating a comparison result according to the rectified input voltage Vin and a predetermined level Vpdl. The timer circuit 162 is coupled to the comparison circuit 161, for counting a predetermined time period since the rectified input voltage exceeds the predetermined level Vpdl, to generate the adjustment signal. The aforementioned "coupled to the rectified input voltage Vin" is not limited to a direct connection, but it may be an indirect connection such as obtaining a divided voltage from the rectified input voltage Vin.

Figure 11:
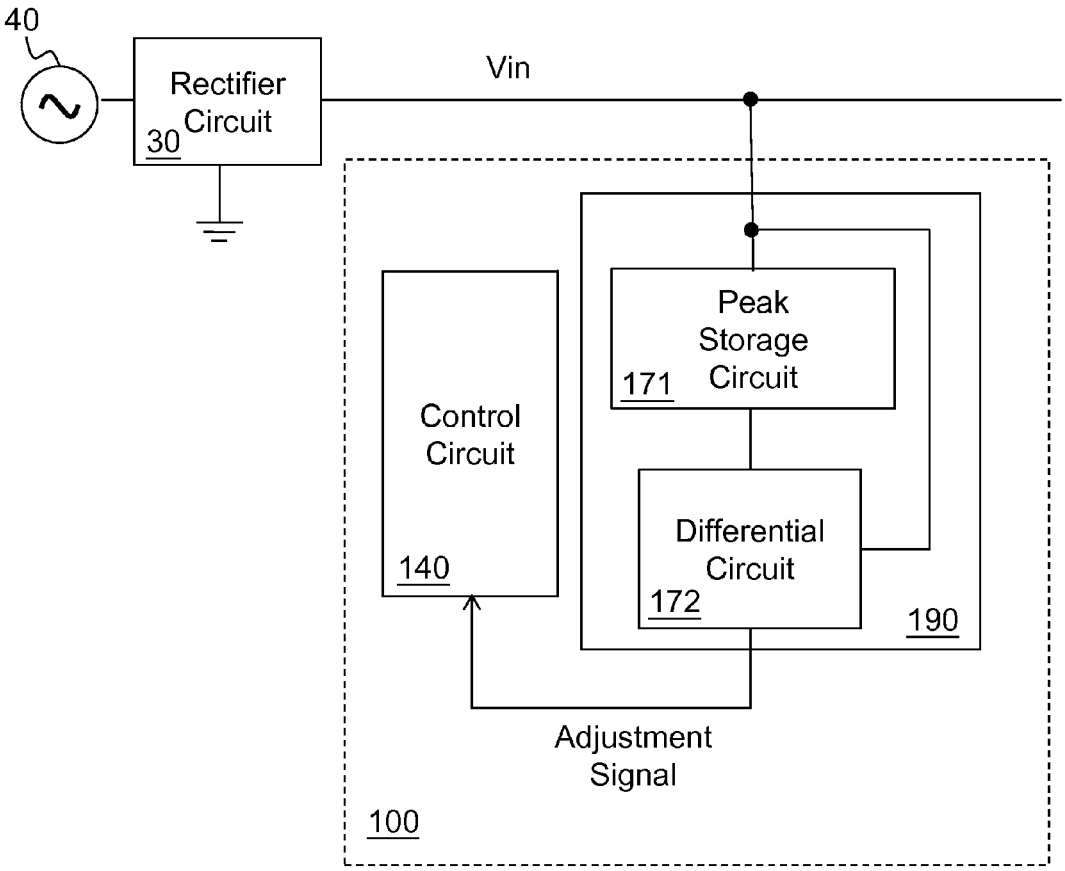
FIG. 11 shows a tenth embodiment of the present invention.

FIG. 11 shows a tenth embodiment of the present invention. This embodiment shows another embodiment of the adjustment signal generation circuit 190. As shown in FIG. 11, in this embodiment, the adjustment signal generation circuit 190 includes a peak detection and storage circuit 171 and a differential circuit 172. The peak detection and storage circuit 171 is coupled to the rectified input voltage Vin, for storing a peak level of the rectified input voltage Vin in an immediate previous cycle. The differential circuit 172 is coupled to the peak detection and storage circuit 171, for generating the adjustment signal according to a difference of the current rectified input voltage Vin and the peak level.

The present invention has been described in considerable detail with reference to certain preferred embodiments thereof. It should be understood that the description is for illustrative purpose, not for limiting the scope of the present invention. Those skilled in this art can readily conceive variations and modifications within the spirit of the present invention. For example, a device or circuit which does not substantially influence the primary function of a signal can be inserted between any two devices or circuits in the shown embodiments, so the term "couple" should include direct and indirect connections. For another example, the light emitting devices connected in series can be further connected to other light emitting devices in parallel. For another example, the light emitting device that is applicable to the present invention is not limited to the LED as shown and described in the embodiments above, but may be any light emitting device with a forward terminal and a reverse terminal. For another example, each light emitting device shown in the embodiments of the present invention can be replaced by any other number of light emitting devices (one light emitting device replaced by plural light emitting devices in series and/or parallel), and the sequence to change the number of conductive light emitting device(s) is not limited to increasing or decreasing one light emitting device at each change. In view of the foregoing, the spirit of the present invention should cover all such and other modifications and variations, which should be interpreted to fall within the scope of the following claims and their equivalents.

What is claimed is:

1. A light emitting device driver circuit for driving a light emitting device circuit which is operative according to a rectified input voltage, the light emitting device circuit including a plurality of light emitting devices connected in series and a diode circuit, wherein the diode circuit includes at least one diode or a light emitting diode (LED), and wherein the light emitting device circuit and the diode circuit are connected in series, the plural light emitting devices being divided into a plurality of groups, wherein each group includes at least one light emitting device, the light emitting device driver circuit comprising:

a first switch circuit, which includes a plurality of first switches, wherein each first switch is connected to a corresponding one of the groups in parallel;

a second switch circuit, which includes a plurality of second switches, wherein each forward end and each reverse end of each diode or LED in the diode circuit is coupled to a corresponding one of the second switches;

a current source circuit, which is coupled to the second switch circuit, for providing a light emitting device current when at least one of the light emitting devices is conductive, wherein the second switch circuit determines whether to electrically connect the forward end or the reverse end of the at least one diode or LED in the diode circuit to the current source circuit according to voltages of the forward end and the reverse end; and a control circuit, which is coupled to the first switch circuit, for generating an operation signal according to an adjustment signal, to operate at least one first switch of the first switch circuit to determine which of the light emitting devices is conductive.

2. The driver circuit of claim 1, wherein each diode or LED in the diode circuit has a same forward threshold voltage as at least one of the light emitting devices.

3. The driver circuit of claim 1, wherein the adjustment signal is related to the voltages of the forward end and the reverse end of the at least one diode or LED.

4. The driver circuit of claim 3, further comprising an adjustment signal generation circuit, which includes:

a first comparison circuit, for comparing the voltage of the forward end with a reference signal to generate a first comparison signal;

a second comparison circuit, for comparing the voltage of the reverse end with a voltage difference to generate a second comparison signal, wherein the voltage difference is related to the voltage of the forward end minus the voltage of the reverse end; and a counter, which is coupled to the first comparison circuit and the second comparison circuit, for generating the adjustment signal according to the first comparison signal and the second comparison signal.

5. The driver circuit of claim 1, wherein the second switch circuit includes:

the plurality of second switches, wherein each of the second switch has a second switch current inflow end, a second switch current outflow end, and a second switch control end, wherein the second switch current inflow end is coupled to the forward end or the reverse end, and the second switch current outflow end is coupled to the current source circuit;

a plurality of predetermined current sources;

a plurality of third switches, wherein each of the third switches has a third switch current inflow end, a third switch current outflow end, and a third switch control end, wherein the third switch current inflow end is for receiving a current generated by a corresponding one of the predetermined current sources, and is coupled to the second switch control end, and the third switch control end is coupled to the second switch current outflow end of the corresponding second switch; and a plurality of resistors, each of which is coupled to the third switch current outflow end of a corresponding one of the third switches.

6. The driver circuit of claim 1, wherein the light emitting device circuit further includes an additional group including at least one additional light emitting device which is not one of the plurality of light emitting devices connected in series, the additional group being connected in series with the plurality of light emitting devices connected in series, and the additional group being not connected to any switch in parallel.

7. The driver circuit of claim 1, further comprising a sensing circuit which is coupled to the first switch circuit and/or the second switch circuit, for generating the adjustment signal according to a voltage drop across, a current flowing through, or a turned-ON or turned-OFF time point of one or more first switches and/or one or more second switches.

8. The driver circuit of claim 1 further comprising:

a comparison circuit, which is coupled to the rectified input voltage, for generating a comparison result according to the rectified input voltage and a predetermined level; and a timer circuit, which is coupled to the comparison circuit, for counting a predetermined time period since the rectified input voltage exceeds the predetermined level, to generate the adjustment signal.

9. The driver circuit of claim 1 further comprising:

a peak detection and storage circuit, which is coupled to the rectified input voltage, for storing a peak level of the rectified input voltage in an immediate previous cycle; and a differential circuit, which is coupled to the peak detection and storage circuit, for generating the adjustment signal according to a difference of the current rectified input voltage and the peak level.

10. The driver circuit of claim 1, wherein a number of the light emitting device or devices of at least one of the groups is different from another group.

* * * * *